US010692451B2

(12) United States Patent
Ono et al.

(10) Patent No.: US 10,692,451 B2
(45) Date of Patent: Jun. 23, 2020

(54) LIQUID CRYSTAL CONTROL CIRCUIT, ELECTRONIC TIMEPIECE, AND LIQUID CRYSTAL CONTROL METHOD

(71) Applicant: CASIO COMPUTER CO., LTD., Shibuya-ku, Tokyo (JP)

(72) Inventors: Takahiro Ono, Akishima (JP); Fumiaki Ochiai, Higashiyamato (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/356,947

(22) Filed: Mar. 18, 2019

(65) Prior Publication Data

US 2019/0295484 A1 Sep. 26, 2019

(30) Foreign Application Priority Data

Mar. 22, 2018 (JP) ..... 2018-054784

(51) Int. Cl.
*G09G 3/36* (2006.01)
*G04G 9/04* (2006.01)

(52) U.S. Cl.
CPC ..... *G09G 3/3614* (2013.01); *G04G 9/04* (2013.01); *G09G 2310/08* (2013.01)

(58) Field of Classification Search
CPC ..... G09G 3/3614; G09G 2310/08; G09G 3/3655; G09G 2300/0857;
(Continued)

(56) References Cited

U.S. PATENT DOCUMENTS

2012/0306835 A1 12/2012 Kitagawa et al.
2013/0229403 A1* 9/2013 Teranishi ..... G09G 3/3607 345/212

(Continued)

FOREIGN PATENT DOCUMENTS

JP 2003-177717 A 6/2003
JP 2013-182102 A 9/2013
JP 5450784 B2 3/2014

OTHER PUBLICATIONS

Japan Display Inc., "Specification [Product Name: LPM013M126A]," Version 1, Jul. 20, 2016. (36 pages).

(Continued)

*Primary Examiner* — Ibrahim A Khan
(74) *Attorney, Agent, or Firm* — Seed IP Law Group LLP

(57) ABSTRACT

A liquid crystal controller is provided for a liquid crystal panel having a plurality of pixels, each of which includes a memory element and a display element. The memory element is configured to hold electric potential depending on an image signal and is configured to change the held electric potential based on activation of an enable signal. The display element is configured to be applied voltage depending on the electric potential which the memory element holds. The liquid crystal controller is configured to: hold off outputting the enable signal, for a period th before polarity of AC voltage applied to the display element is inverted and a period (tr+ts) after the polarity of the AC voltage is inverted; and hold off inversion of the polarity of the AC voltage, for an output period of the enable signal and the period th after the output period.

9 Claims, 9 Drawing Sheets

(58) Field of Classification Search
CPC ..... G09G 2330/021; G04G 9/04; G04G 9/12; G04G 9/0005; G04G 9/06; G04G 9/0094
See application file for complete search history.

(56) References Cited

U.S. PATENT DOCUMENTS

| | | | | |
|---|---|---|---|---|
| 2013/0229444 | A1* | 9/2013 | Teranishi | G09G 5/10 345/690 |
| 2013/0241974 | A1* | 9/2013 | Teranishi | G09G 3/207 345/691 |
| 2014/0071183 | A1* | 3/2014 | Murayama | G09G 3/344 345/690 |
| 2014/0092080 | A1* | 4/2014 | Fukunaga | G09G 3/3696 345/212 |
| 2014/0184968 | A1* | 7/2014 | Niikura | G02F 1/1391 349/42 |
| 2015/0243255 | A1 | 8/2015 | Teranishi | |
| 2015/0255029 | A1* | 9/2015 | Niikura | G09G 3/3648 345/98 |
| 2016/0247458 | A1* | 8/2016 | Muto | G09G 3/344 |
| 2016/0275891 | A1 | 9/2016 | Teranishi | |
| 2018/0018918 | A1* | 1/2018 | Miyake | G09G 3/36 |
| 2018/0068625 | A1* | 3/2018 | Ho | G09G 3/3659 |
| 2019/0096354 | A1* | 3/2019 | Chen | G09G 3/3648 |

OTHER PUBLICATIONS

Gyouten, "Configuration and Characteristic of Memory Liquid Crystal Display" *Technical Report of SHARP* 100:23-27, 2010.

* cited by examiner

LIQUID CRYSTAL CONTROL CIRCUIT, ELECTRONIC TIMEPIECE, AND LIQUID CRYSTAL CONTROL METHOD

CROSS-REFERENCE TO RELATED APPLICATION

This application is based on and claims priority under 35 USC 119 from Japanese Patent Application No. 2018-054784 filed on Mar. 22, 2018, the contents of which are incorporated herein by reference.

BACKGROUND

1. Technical Field

The technical field relates to a liquid crystal control circuit, an electronic timepiece, and a liquid crystal control method.

2. Description of the Related Art

Nowadays, since a lot of mobile devices are driven by batteries, the available time of each device is determined by the power consumption of the system and the capacity of the battery. For this reason, it is essential to reduce the power consumption of each system, and it is very strongly required to reduce the power consumption of each of devices to be installed in such mobile devices. For this purpose, MIP (Memory-in-Pixel) liquid crystal panels are suitable.

In liquid crystal panels having memory elements, such as an MIP liquid crystal panel disclosed in Japanese Patent Application Laid-Open No. 2003-177717 which is a Japanese Patent Literature, in order to maintain the reliability of the liquid crystal panels, the timings when a VCOM inversion signal is applied to display elements are not synchronized with the timings when image data signals is applied. In such liquid crystal panels, if the VCOM inversion timing for each display element and the timing of reflection of an image data signal overlap, image writing may not be normally performed. For this reason, timing control for avoiding competition between the VCOM inversion timing and the image data reflection timing for each display element is required.

SUMMARY

A liquid crystal control circuit, an electronic timepiece, and a liquid crystal control method are disclosed herein.

A liquid crystal control circuit related to one embodiment is provided for driving a liquid crystal panel having a plurality of pixels, each of which includes a memory element and a display element. The memory element is configured to hold electric potential depending on an image signal and is configured to change the held electric potential based on activation of an enable signal. The display element is configured to be applied voltage depending on the electric potential which the memory element holds. The liquid crystal control circuit is configured to: hold off outputting the enable signal, for a predetermined first period before polarity of AC voltage applied to the display element is inverted and a predetermined second period after the polarity of the AC voltage is inverted; and hold off inversion of the polarity of the AC voltage, for an output period of the enable signal and the predetermined first period after the output period.

DETAILED DESCRIPTION

Hereinafter, an embodiment will be described in detail with reference to the drawings.

The present embodiment performs timing control for avoiding competition between the VCOM inversion timing and the image data reflection timing for each display element of a liquid crystal panel. The present embodiment copes with both of the case where VCOM is first output and the case where data is first output.

<Hardware Configuration>

Figure 1:
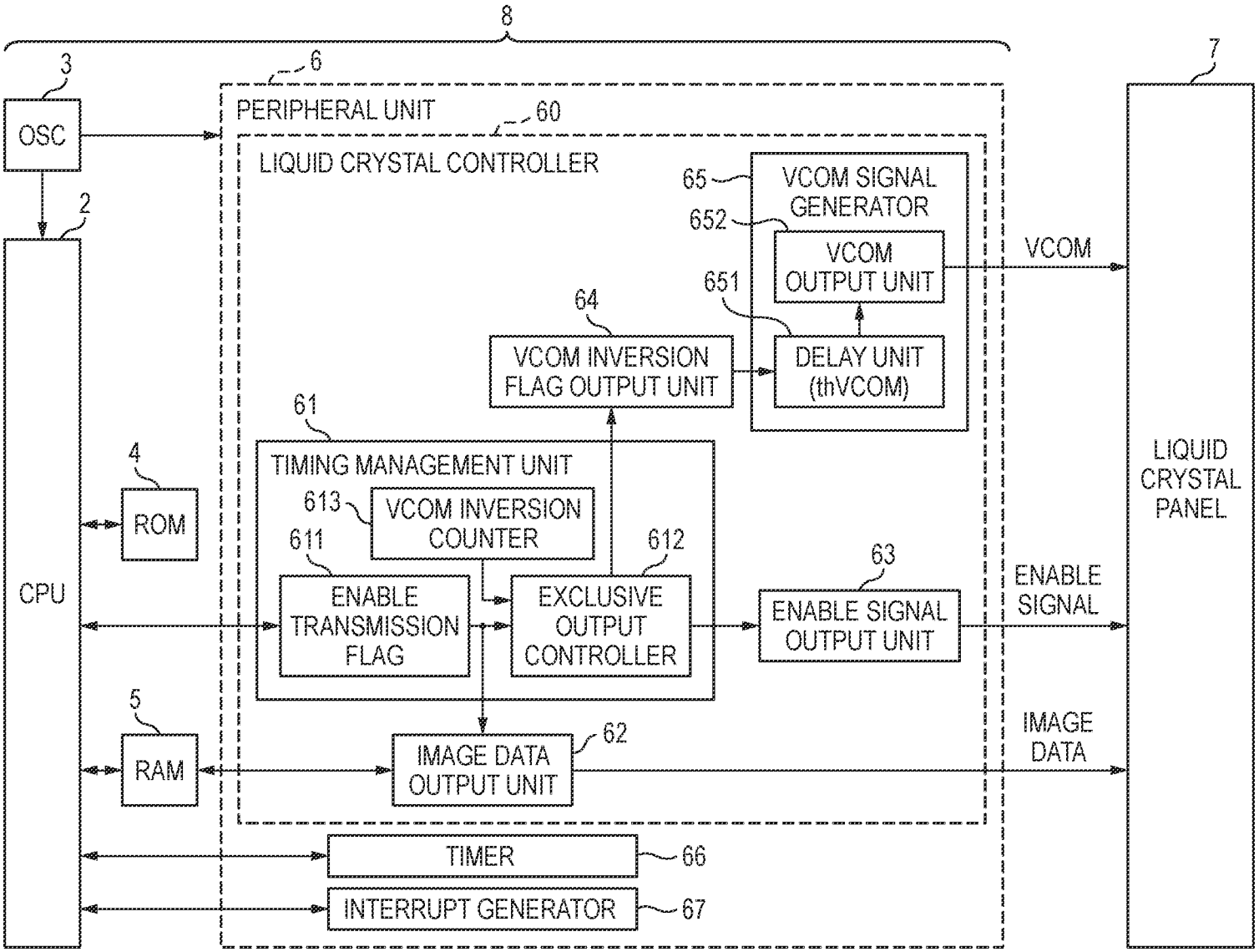
FIG. 1 is a view schematically illustrating the configuration of an electronic timepiece including a liquid crystal controller according to an embodiment.

FIG. 1 is a view schematically illustrating the configuration of an electronic timepiece including a liquid crystal controller 60 according to the present embodiment.

An electronic timepiece 1 includes an oscillator 3, a microcontroller 8, and a liquid crystal panel 7 electrically connected thereto. However, in FIG. 1, the oscillator 3 is written as "OSC". The liquid crystal panel 7 is, for example, an MIP (Memory-in-Pixel) liquid crystal panel, and has a plurality of pixels, each of which has a memory element configured to hold electric potential according to an image signal and change the held electric potential when an enable signal is activated and a display element to which voltage according to the electric potential which the memory element holds is applied. The oscillator 3 is an element for producing continuous and periodic oscillations, and is, for example, a crystal oscillator or the like.

The microcontroller 8 is an integrated circuit having a CPU (Central Processing Unit) 2, a ROM (Read Only Memory) 4, a RAM (Random Access Memory) 5, and a peripheral unit 6. The microcontroller 8 controls the whole of the electronic timepiece by executing a control program stored in the ROM 4 by the CPU 2. The CPU 2 uses the RAM 5 as a work area when executing the control program.

The peripheral unit 6 includes the liquid crystal controller 60 configured to drive and control the liquid crystal panel 7 such that the liquid crystal panel performs display, a timer 66 configured to measure waiting time and so on, and an interrupt generator 67 configured to generate an interrupt and output the interrupt to the CPU 2.

The liquid crystal controller 60 includes a timing management unit 61, an image data output unit 62, an enable signal output unit 63, a VCOM inversion flag output unit 64, and a VCOM signal generator 65. The liquid crystal controller 60 is a liquid crystal control circuit for driving and controlling the liquid crystal panel 7 such that the liquid crystal panel performs display.

The liquid crystal controller 60 holds off outputting the enable signal, for a period th (a predetermined first period) before inversion of polarity of AC voltage which is applied to each display element of the liquid crystal panel 7 and a period (tr+ts) (a predetermined second period) after the inversion of the polarity of the AC voltage. Here, "holding off" means holding the previous state (when "holding off" hereinafter is referred to, it has the same meaning. Also, the enable signal is a signal for changing the electric potential which is each memory element of the liquid crystal panel 7 holds, according to image data transmitted from the image data output unit 62. In other words, by activating the enable signal, it is possible to change the electric potential which each memory element of the liquid crystal panel 7 holds, according to image data transmitted from the image data output unit 62. In other words, if receiving the enable signal from the enable signal output unit 63, the liquid crystal panel 7 changes the electric potential which each memory element holds, according to image data transmitted from the image data output unit 62.

The liquid crystal controller 60 also holds off inverting the polarity of the AC voltage which is applied to each display element of the liquid crystal panel 7, for the output period of the enable signal and the subsequent period th (the predetermined first period). In this way, the liquid crystal controller 60 secures the period from inversion of the polarity of the AC voltage to start of outputting of the enable signal, as the period (tr+ts). Also, the liquid crystal controller 60 secures the period from end of outputting of the enable signal to inversion of the polarity of the AC voltage, as the period th.

The timing management unit 61 includes a VCOM inversion counter 613 and an exclusive output controller 612. The timing management unit 61 processes an enable transmission flag 611 that the CPU 2 outputs, and outputs to the VCOM inversion flag output unit 64 and the enable signal output unit 63.

The VCOM inversion counter 613 is a counter for notifying that an interval tc set in the special function register (SFR) has elapsed. The VCOM inversion counter 613 functions as a counter for outputting an inversion request signal for requesting inversion of the polarity of the AC voltage to be applied to each display element of the liquid crystal panel 7, at a predetermined interval.

The exclusive output controller 612 exclusively outputs the enable transmission flag for the enable signal output unit 63 and a signal for the VCOM inversion counter 613. In other words, while the enable transmission flag is in the ON state, the exclusive output controller 612 holds off transmitting the output of the VCOM inversion counter 613 to the VCOM inversion flag output unit 64. Also, while the VCOM inversion flag is output, the exclusive output controller 612 holds off outputting data to the enable signal output unit 63. The exclusive output controller 612 determines whether to output the inversion request signal to the VCOM inversion flag output unit 64, or output the enable transmission flag (an output request signal) to the enable signal output unit 63.

The VCOM inversion flag output unit 64 outputs a predetermined value as the VCOM inversion flag. The VCOM inversion flag serves as the inversion request signal for making the VCOM signal generator 65 invert the polarity of the AC voltage. The VCOM inversion flag may be one bit or more bits, and is not limited.

The image data output unit 62 is a unit for transmitting image data stored in the RAM 5 to the liquid crystal panel 7, on the basis of the enable transmission flag 611 which the CPU 2 outputs. The image data output unit 62 may be configured, for example, as a DMA (Direct Memory Access) controller.

The VCOM signal generator 65 (a polarity inversion circuit) includes a delay unit 651 and a VCOM output unit 652. The delay unit 651 outputs a predetermined value to the VCOM output unit 652 if the predetermined period th (the predetermined first period) during which the predetermined value is input from the VCOM inversion flag output unit 64 elapses. The VCOM output unit 652 inverts the polarity of the VCOM which is an output signal, if receiving the predetermined value from the delay unit 651. However, the VCOM output unit 652 may just change the value of the output signal if receiving the predetermined value from the delay unit 651.

In other words, the VCOM signal generator 65 functions as a polarity inversion unit for inverting the polarity of the AC voltage according to the inversion request signal.

Figure 2:
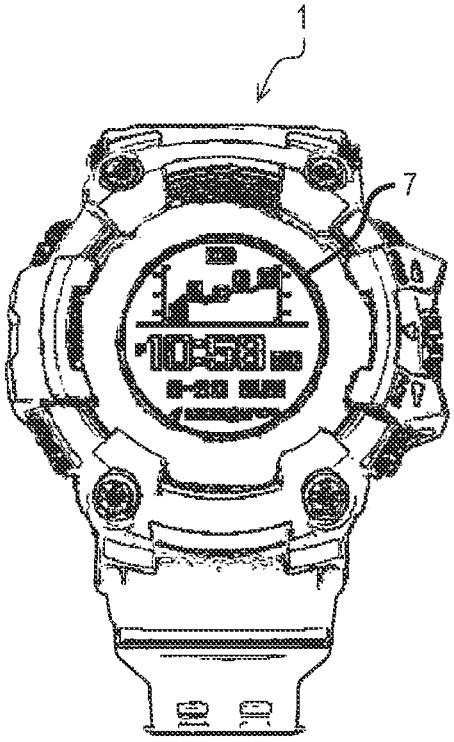
FIG. 2 is a view illustrating the external appearance of the electronic timepiece.

FIG. 2 is a view illustrating the external appearance of the electronic timepiece 1.

The electronic timepiece 1 is a digital watch, and displays the time in numbers. Since the electronic timepiece 1 is required to be driven with a very small battery for a long period, it is very important to reduce the power consumption.

<Operation of Liquid Crystal Controller 60>

Figure 3:
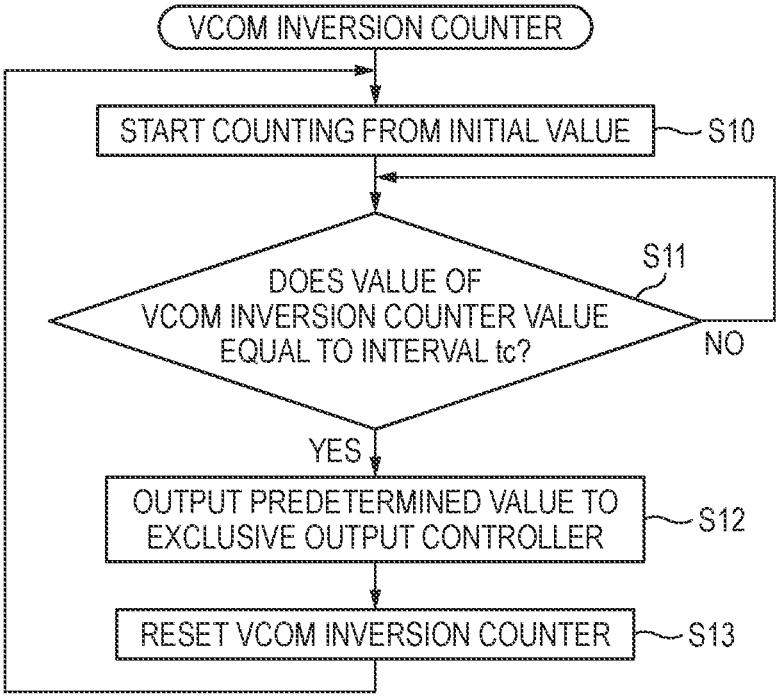
FIG. 3 is a flow chart illustrating a process of a VCOM inversion counter.

FIG. 3 is a flow chart illustrating a process of the VCOM inversion counter 613.

The VCOM inversion counter 613 is a counter whose value changes with time, and is used in the present embodiment to measure the interval tc which is the VCOM inversion interval. The VCOM inversion counter 613 may increase the value with time, or may decrease the value with the time.

The VCOM inversion counter 613 starts counting from an initial value (STEP S10), and keeps counting ("No" in STEP S11) until the count value becomes a value corresponding to the interval tc.

If the count value becomes the value corresponding to the interval tc ("Yes" in STEP S11), the VCOM inversion counter 613 outputs the predetermined value to the exclusive output controller 612 (STEP S12). The value corresponding to the interval tc is set in the VCOM inversion counter 613 in advance.

Thereafter, the VCOM inversion counter 613 resets the count value (STEP S13), and returns to STEP S10, and repeats measuring of the interval tc.

Figure 4:
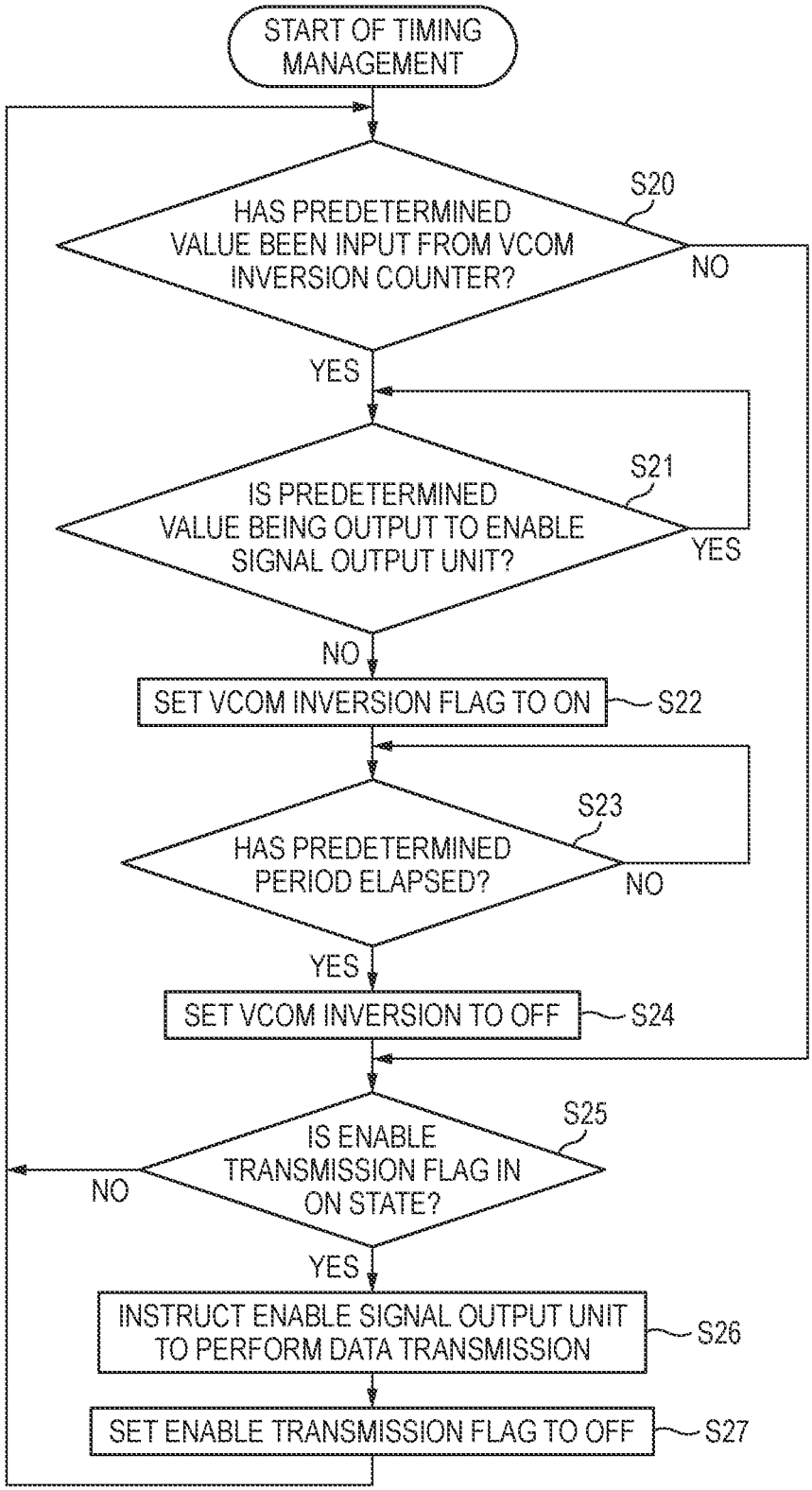
FIG. 4 is a flow chart illustrating a process of a timing management unit.

FIG. 4 is a flow chart illustrating processes of the exclusive output controller 612 and the VCOM inversion flag output unit 64.

If the count value of the VCOM inversion counter 613 becomes the value corresponding to the interval tc, and the predetermined value is input to the exclusive output controller 612 ("Yes" in STEP S20), the exclusive output controller proceeds to STEP S21. If the predetermined value has not been input from the VCOM inversion counter 613 ("No" in STEP S20), the exclusive output controller 612 proceeds to the process of STEP S25.

In STEP S21, the enable signal output unit 63 determines whether the predetermined value is being output to the enable signal output unit 63. If the predetermined value is being output to the enable signal output unit 63 ("Yes" in STEP S21), the exclusive output controller 612 repeats the determination of STEP S21. In other words, by the process of STEP S21, the exclusive output controller 612 can hold off setting the VCOM inversion flag to ON, for the output period of the enable signal.

If the predetermined value is not being output to the enable signal output unit 63 ("No" in STEP S21), the exclusive output controller 612 controls the VCOM inversion flag output unit 64 such that the VCOM inversion flag output unit sets the VCOM inversion flag to ON (STEP S22). The VCOM inversion flag output unit 64 determines whether a predetermined period (th+tr+ts) has elapsed (STEP S23). If the predetermined period has not elapsed ("No" in STEP S23), the exclusive output controller 612 repeats the determination of STEP S23.

If the predetermined period has elapsed ("Yes" in STEP S23), the VCOM inversion flag output unit 64 sets the VCOM inversion flag to OFF (STEP S24), and proceeds to the process of STEP S25. By the processes of STEP S22 to STEP S24, it is possible to maintain the VCOM inversion flag in the ON state for the predetermined period.

In STEP S25, the exclusive output controller 612 determines whether the enable transmission flag 611 is in the ON state. If the enable transmission flag 611 is not in the ON state ("No"), the exclusive output controller 612 returns to the process of STEP S20.

If the enable transmission flag 611 is in the ON state ("Yes"), the exclusive output controller 612 instructs the enable signal output unit 63 to perform data transmission (STEP S26). Then, if the enable transmission flag is set to OFF (STEP S27), the exclusive output controller 612 returns to the process of STEP S20.

Figure 5:
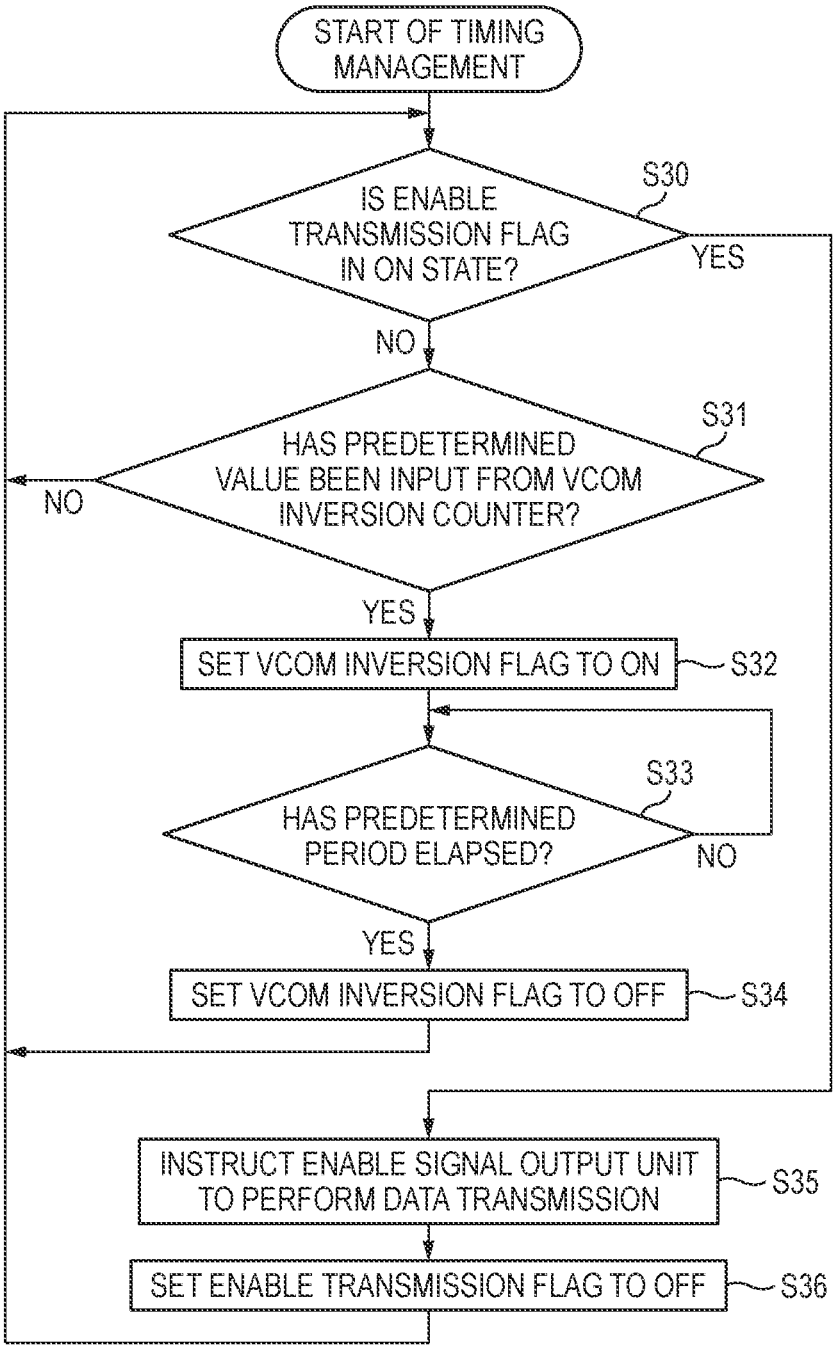
FIG. 5 is a flow chart illustrating a process of a timing management unit according to a modification.

FIG. 5 is a flow chart illustrating processes of the exclusive output controller 612 and the VCOM inversion flag output unit 64 according to a modification.

The exclusive output controller 612 determines whether the enable transmission flag 611 is in the ON state (STEP S30). If the enable transmission flag 611 is not in the ON state ("No"), the exclusive output controller 612 returns to the process of STEP S31.

In STEP S31, the exclusive output controller 612 determines whether the predetermined value has been input from the VCOM inversion counter 613. If the predetermined value is input from the VCOM inversion counter 613 ("Yes" in STEP S31), the exclusive output controller 612 proceeds to the process of STEP S32. If the predetermined value has not been input from the VCOM inversion counter 613 ("No" in STEP S31), the exclusive output controller 612 returns to the process of STEP S30.

In STEP S32, the exclusive output controller 612 controls the VCOM inversion flag output unit 64 such that the VCOM inversion flag output unit sets the VCOM inversion flag to ON. The VCOM inversion flag output unit 64 determines whether the predetermined period (th+tr+ts) has elapsed (STEP S33). If the predetermined period has not elapsed ("No" in STEP S33), the exclusive output controller 612 repeats the determination of STEP S33.

If the predetermined period has elapsed ("Yes" in STEP S33), the VCOM inversion flag output unit 64 sets the VCOM inversion flag (STEP S34) to OFF, and returns to the process of STEP S30. By the processes of STEP S32 to STEP S34, it is possible to maintain the VCOM inversion flag in the ON state for the predetermined period.

If the enable transmission flag 611 is in the ON state ("Yes" in STEP S30), the exclusive output controller 612 proceeds to STEP S36, and instructs the enable signal output unit 63 to perform data transmission. Then, if the enable transmission flag is set to OFF (STEP S37), the exclusive output controller 612 returns to the process of STEP S30.

Figure 6:
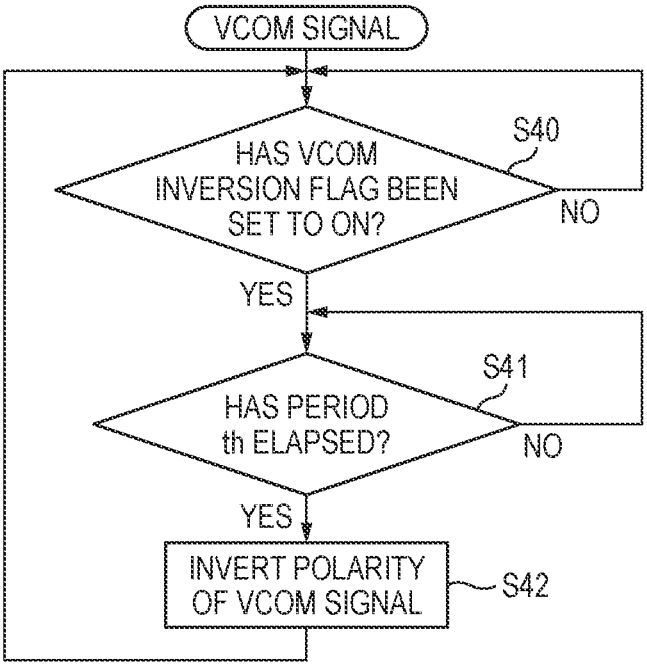
FIG. 6 is a flow chart illustrating a process of a VCOM inversion flag output unit.

FIG. 6 is a flow chart illustrating a process of the VCOM signal generator 65. The flow chart of STEP S40 to STEP S42 shows the operations of the delay unit 651 and the VCOM output unit 652 constituting the VCOM signal generator 65.

If a transition of the VCOM inversion flag output from the VCOM inversion flag output unit 64 from the OFF state to ON state is not detected ("No" in STEP S40), the delay unit 651 waits for the VCOM inversion flag to be set to ON. If the VCOM inversion flag is set to ON ("Yes" in STEP S40), the process proceeds to determination of STEP S41.

In STEP S41, the delay unit 651 waits until the period th elapses ("No" in STEP S41. After the period th elapses ("Yes" in STEP S41), the delay unit 651 outputs the signal for inverting the polarity of the VCOM signal, to the VCOM output unit 652 (STEP S42). If the VCOM output unit 652 inverts the polarity of the VCOM signal, the process of STEP S40 is repeated.

Figure 7:
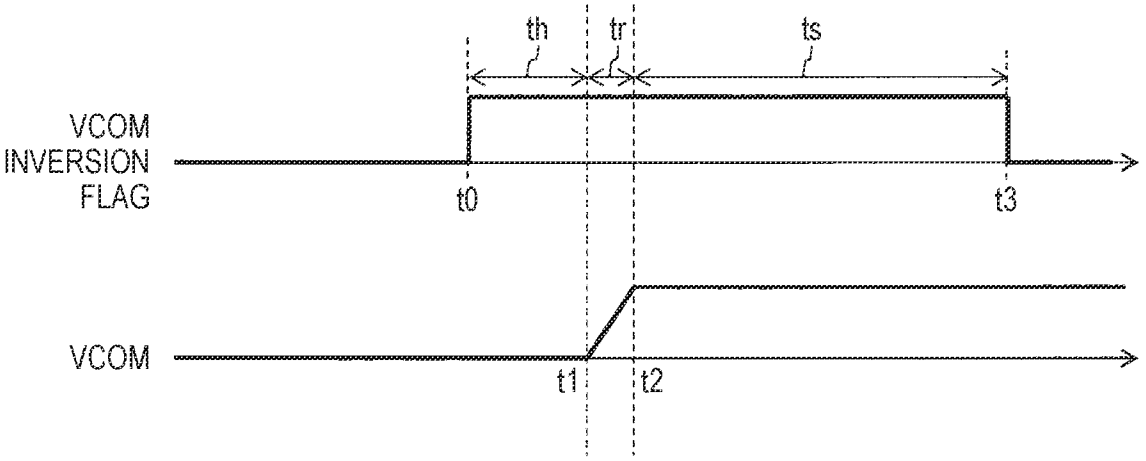
FIG. 7 is a time chart illustrating a VCOM inversion flag and VCOM.

FIG. 7 is a time chart illustrating the VCOM inversion flag and the VCOM.

At a time point t0, the VCOM inversion flag is set to ON. Thereafter, at a time point t1 which is the time point later than the time point t0 by the period th, a rising of the VCOM signal starts. The period th is the period measured by the delay unit 651.

Then, at a time point t2 which is the time point later than the time point t1 by the period tr, the rising of the VCOM signal ends. Here, a rising of the VCOM signal is shown; however, the VCOM signal may fall.

At a time point t3 which is the time point later than the time point t2 by the period ts, the VCOM inversion flag is set to OFF.

Figure 8:
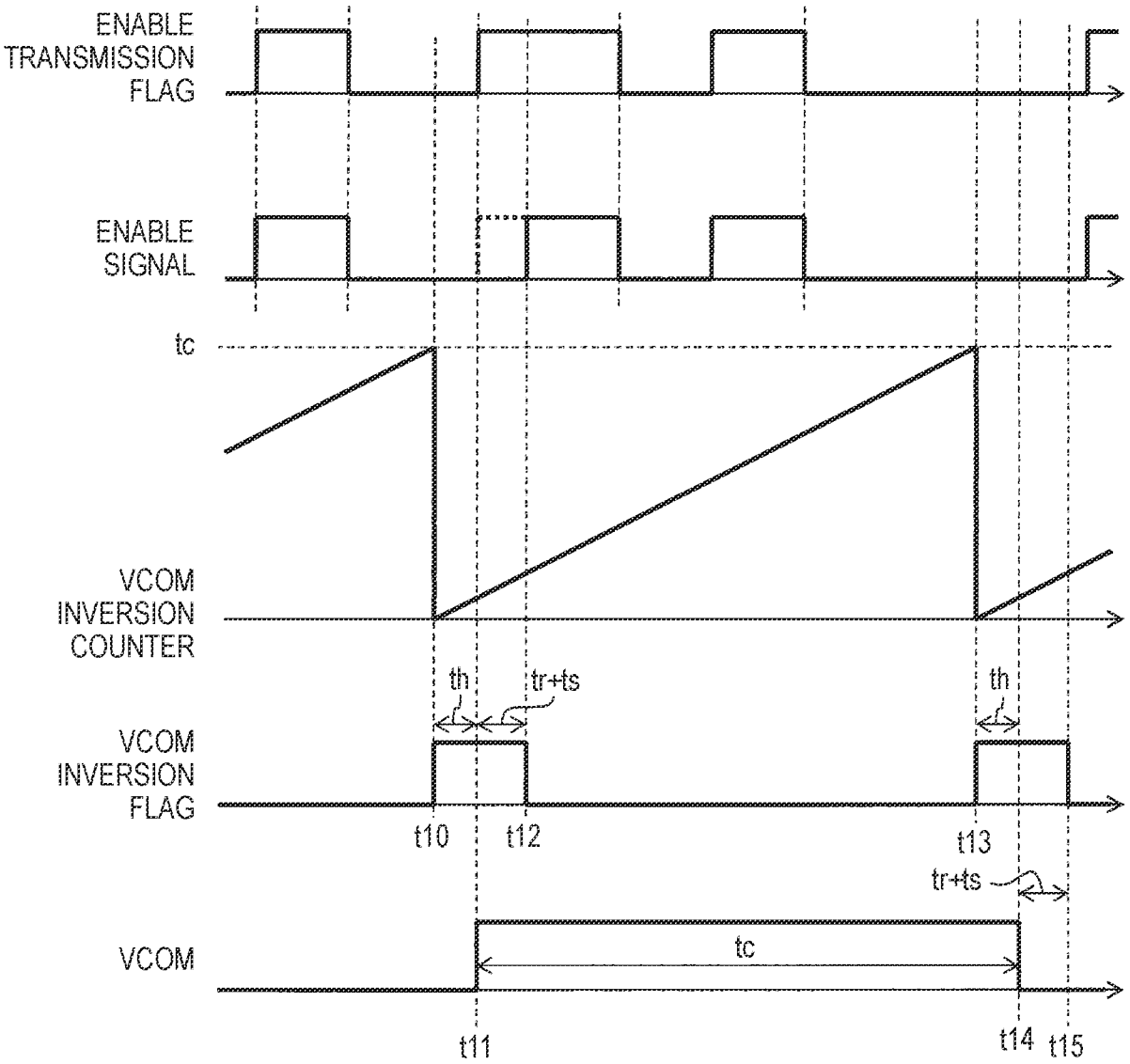
FIG. 8 is a time chart illustrating the case where data transmission is held off by VCOM inversion.
Figure 9:
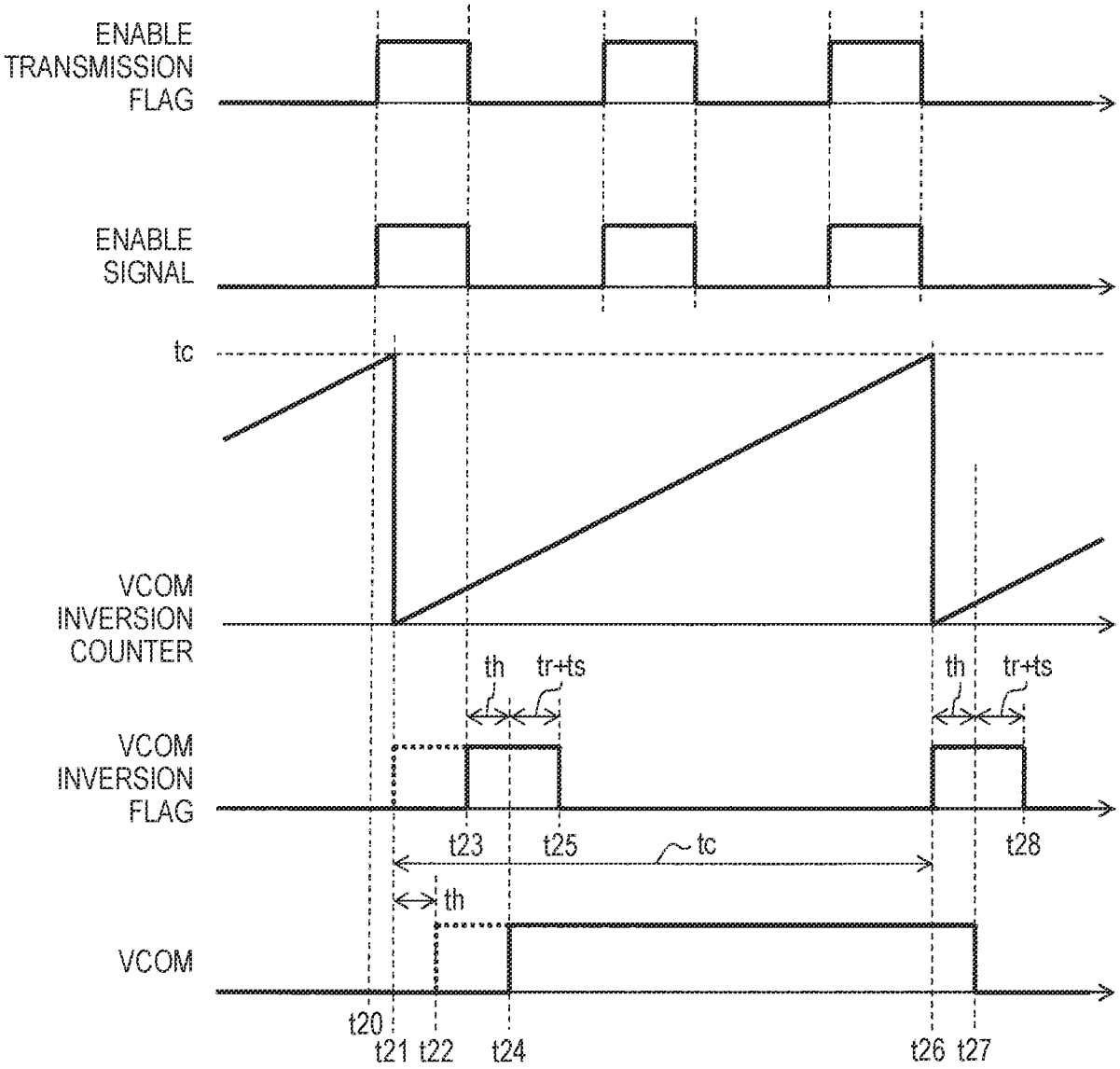
FIG. 9 is a time chart illustrating the case where VCOM inversion is held off due to data transmission.
Figure 10:
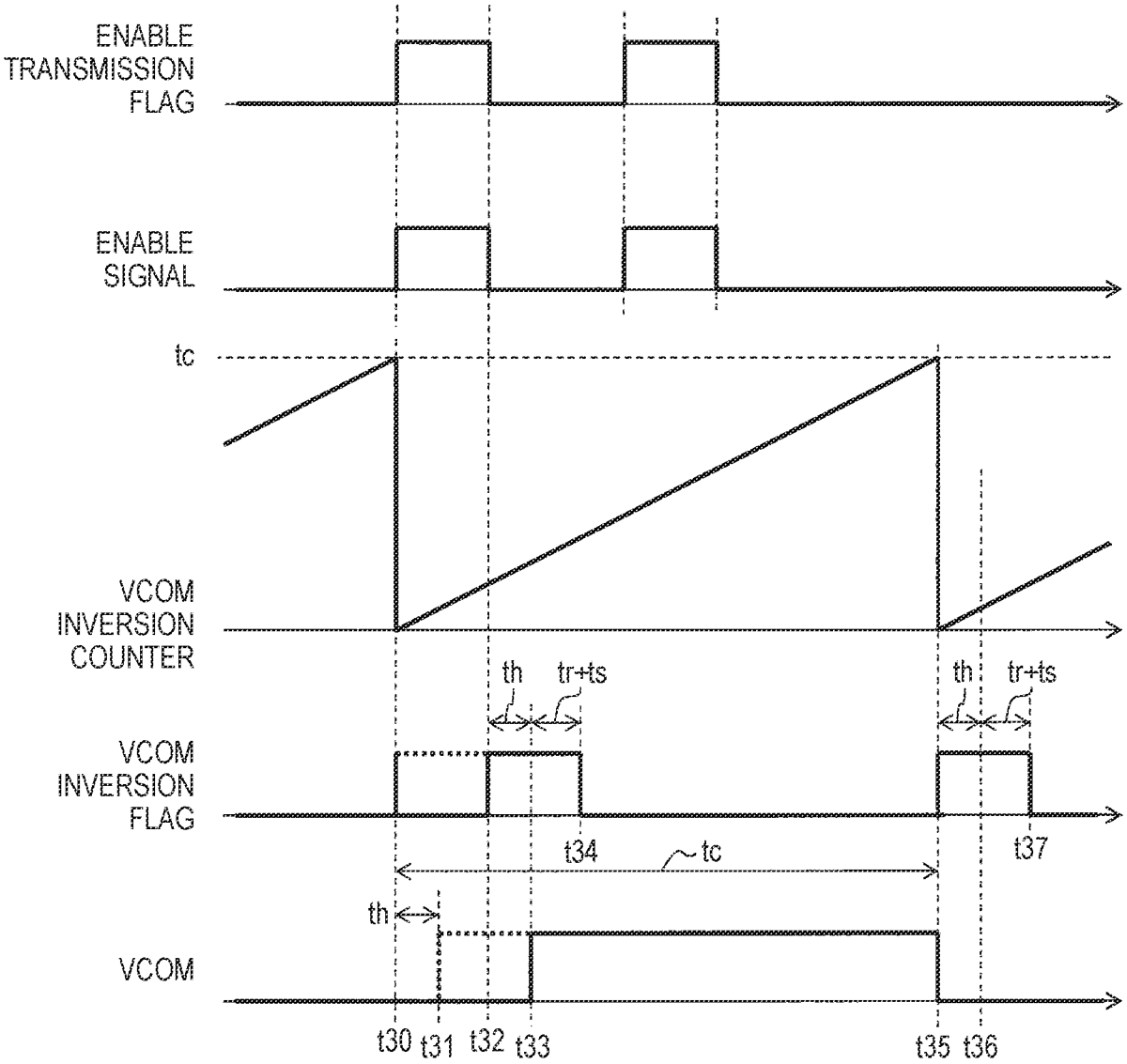
FIG. 10 is a time chart illustrating the case where data transmission and an event of the VCOM inversion counter occur at the same time.

FIG. 8 is a time chart illustrating the case where data transmission is hold off by VCOM inversion. In FIG. 8 to FIG. 10, the enable signal is shown by an envelope. When the graph of the enable signal is shown as being at the H level, a plurality of pulse signals is output. While the enable signal is output, the liquid crystal panel 7 changes the electric potential which each memory element holds, according to image data which are transmitted from the image data output unit 62.

At a time point t10, the VCOM inversion counter 613 reaches the value corresponding to the interval tc, and then is reset. Therefore, the VCOM inversion flag is set to ON.

A time point t11 is the time point later than the time point t10 by the period th. At the time point t11, the VCOM signal rises, and the enable transmission flag 611 transitions from the OFF state to the ON state. In general, the enable transmission flag 611 is set to ON at the same time as the enable signal rises. However, at the time point t11, the enable signal is maintained without rising. In FIG. 8, this is shown by a broken line.

A time point t12 is the time point later than the time point t11 by the period (tr+ts). At the time point t12, the VCOM inversion flag is set to OFF, and at the same time, the enable signal rises.

Like this, while the VCOM inversion flag is in the ON state, even if the enable transmission flag transitions from the OFF state to the ON state, outputting the enable signal is held off. Therefore, it is possible to avoid competition between the VCOM inversion timing and the image data reflection timing for each display element of the liquid crystal panel 7.

At a time point t13, the VCOM inversion counter 613 reaches the value corresponding to the interval tc, and then is reset. As a result, the VCOM inversion flag is set to ON.

A time point t14 is the time point later than the time point t13 by the period th. At the time point t13, the VCOM signal falls, and thus the polarity is inverted.

A time point t15 is the time point later than the time point t14 by the period (tr+ts). At the time point t15, the VCOM inversion flag transitions to the OFF state. In the period from the time point t13 to time point t15, since the enable transmission flag does not transition from the OFF state to the ON state, the enable signal is not output.

The period when the VCOM inversion flag is in the ON state is from the period th before inversion of the VCOM signal and the period (tr+ts) after the inversion of the VCOM signal, and for this period, outputting the enable signal is held off. As described above, outputting the enable signal is held off for the period th before inversion of the AC signal and the period (tr+ts) after the inversion of the AC signal. Therefore, it is possible to avoid competition between the VCOM inversion timing and the image data reflection timing for each display element of the liquid crystal panel 7.

FIG. 9 is a time chart illustrating the case where VCOM inversion is held off due to data transmission.

At a time point t20, the enable transmission flag transitions from the OFF state to the ON state, and at the same time, outputting of the enable signal is started.

At a time point t21, the enable transmission flag is in the ON state. The VCOM inversion counter 613 reaches the value corresponding to the interval tc, and then is reset. However, since the enable transmission flag is in the ON state, setting the VCOM inversion flag to ON is held off. In FIG. 9, the period during which the VCOM signal is held off is shown by a broken line.

A time point t22 is the time point later than the time point t21 by the period th. At the time point t22, under ordinary circumstances, the polarity of the VCOM signal should be inverted; however, since the enable transmission flag is in the ON state, inversion of the polarity of the VCOM signal is held off. In FIG. 9, this is shown by a broken line.

At a time point t23, outputting of the enable signal ends, and at the same time, the enable transmission flag transitions from the ON state to the OFF state. Therefore, the VCOM inversion flag is set to ON.

A time point t24 is the time point later than the time point t23 by the period th. At the time point t24, the polarity of the VCOM signal is inverted.

A time point t25 is the time point later than the time point t24 by the period (tr+ts). At the time point t25, the VCOM inversion flag is set to OFF.

As described above, while the enable transmission flag is in the ON state, even if the VCOM inversion counter 613 reaches the value corresponding to the interval tc, a transition of the VCOM inversion flag is held off. In other words, in the period during the enable transmission flag is in the ON state and the subsequent period th, inversion of the VCOM signal is held off. Therefore, it is possible to avoid competition between the VCOM inversion timing and the image data reflection timing for each display element of the liquid crystal panel 7.

The variations of the individual signals in the period from a time point t26 to a time point t28 are the same as the variations of the individual signals in the period from the time point t10 to the time point t12 shown in FIG. 8.

FIG. 10 is a time chart illustrating the case where data transmission and an event of the VCOM inversion counter occur at the same time.

At a time point t30, the enable transmission flag transitions from the OFF state to the ON state, and at the same time, outputting of the enable signal is started. At the same time, the VCOM inversion counter 613 reaches the value corresponding to the interval tc, and then is reset. However, since the enable transmission flag is in the ON state, setting the VCOM inversion flag to ON is held off. In FIG. 10, the period during which setting the VCOM signal to ON is held off is shown by a broken line.

A time point t31 is the time point later than the time point t30 by the period th. At the time point t31, under ordinary circumstances, the polarity of the VCOM signal should be inverted; however, since the enable transmission flag is in the ON state, inversion of the polarity of the VCOM signal is held off. In FIG. 10, this is shown by a broken line.

At a time point t32, outputting of the enable signal ends, and at the same time the enable transmission flag transitions from the ON state to the OFF state. Therefore, the VCOM inversion flag is set to ON.

A time point t33 is the time point later than the time point t32 by the period th. At the time point t33, the polarity of the VCOM signal is inverted.

A time point t34 is the time point later than the time point t33 by the period (tr+ts). At the time point t34, the VCOM inversion flag is set to OFF.

As described above, even if the VCOM inversion counter 613 reaches the value corresponding the interval tc at the same time as the enable transmission flag is set to ON, a transition of the VCOM inversion flag is held off. Therefore, it is possible to avoid competition between the VCOM signal and image data signals.

The variations of the individual signals in the period from a time point t35 to a time point t37 are the same as the variations of the individual signals in the period from the time point t10 to the time point t12 shown in FIG. 8.

<Effects of Present Embodiment>

In both of the case where the liquid crystal polarity signal (the VCOM signal) is first output and the case where image data is first output, it is possible to avoid competition between the two signals.

(Modifications)

The above-described embodiment can be modified, for example, in the following forms (a) to (c). (a) The liquid crystal controller 60 is installed in the electronic device 1; however, it can be installed in other electronic devices. For example, the liquid crystal controller can be installed in e-book readers, tablets, heart rate monitors, pedometers, thermometers, stopwatches, and so on.

(b) The period th from when the liquid crystal controller 60 receives the output of the VCOM inversion counter 613 to when the VCOM signal is inverted is not limited to a minimum period required to avoid competition between the VCOM inversion timing and the image data reflection timing for each display element of the liquid crystal panel 7, and may be set to have a length equal to that of the minimum period or longer than that of the minimum period by 500 ms (millisecond) or less. 500 ms is the maximum period required in the case where the interval tc which is the VCOM inversion interval is 1 sec and in the case of performing a rewriting operation (for example, an operation of rewriting digits showing second in the electronic timepiece) at intervals of 1 sec.

(c) The period (tr+ts) which is the period from when the VCOM signal is inverted and for which data transmission is held off is not limited to the minimum period required to avoid competition between the VCOM inversion signal and data signals, and may be set to have a length equal to that of the minimum period or longer than that of the minimum period by 500 ms or less. 500 ms is half of the interval tc which is the VCOM inversion interval.

(d) Image data may be stored in the ROM 4, and the image data output unit 62 may transmit the image data stored in the ROM 4 to the liquid crystal panel 7 on the basis of the enable transmission flag 611 which the CPU 2 outputs.

The invention claimed is:

1. A liquid crystal control circuit for driving a liquid crystal panel, wherein the liquid crystal panel has a plurality of pixels, each of which including a memory element and a display element, the memory element is configured to hold electric potential depending on an image signal and is configured to change the held electric potential based on activation of an enable signal, the display element is configured to be applied voltage depending on the electric potential which the memory element holds, and the liquid crystal control circuit is configured to:

hold off outputting the enable signal, for a predetermined first period before polarity of AC voltage applied to the display element is inverted and a predetermined second period after the polarity of the AC voltage is inverted; and hold off inversion of the polarity of the AC voltage, for an output period of the enable signal and the predetermined first period after the output period.

2. The liquid crystal control circuit according to claim 1, wherein the polarity of the AC voltage applied to the display element is inverted at a predetermined interval, while the inversion is not held off based on outputting of the enable signal.

3. An electronic timepiece comprising:

the liquid crystal control circuit according to claim 2; and the liquid crystal panel.

4. An electronic timepiece comprising:

the liquid crystal control circuit according to claim 1; and the liquid crystal panel.

5. A liquid crystal control circuit for driving a liquid crystal panel, wherein the liquid crystal panel has a plurality of pixels, each of which including a memory element and a display element, the memory element is configured to hold electric potential depending on an image signal, the display element is configured to be applied voltage depending on the electric potential which the memory element holds, and the liquid crystal control circuit comprises:

a counter configured to output an inversion request signal for requesting inversion of polarity of AC voltage applied to the display element, at a predetermined interval;

a polarity inversion unit configured to invert the polarity of the AC voltage in response to the inversion request signal;

an enable signal output unit configured to output an enable signal to activate the image signal which is output to the liquid crystal panel; and an exclusive output controller configured to determine whether to output the inversion request signal to the polarity inversion unit or to output the output request signal to the enable signal output unit.

6. The liquid crystal control circuit according to claim 5, wherein the polarity inversion unit is configured to invert the polarity of the AC voltage when a predetermined first period elapses after reception of the inversion request signal.

7. An electronic timepiece comprising:

the liquid crystal control circuit according to claim 6; and the liquid crystal panel.

8. An electronic timepiece comprising:

the liquid crystal control circuit according to claim 5; and the liquid crystal panel.

9. A liquid crystal control method for driving a liquid crystal panel, wherein the liquid crystal panel has a plurality of pixels, each of which including a memory element and a display element, the memory element is configured to hold electric potential depending on an image signal and is configured to change the held electric potential based on activation of an enable signal, the display element is configured to be applied voltage depending on the electric potential which the memory element holds, and the liquid crystal control method comprises:

holding off outputting the enable signal, for a predetermined first period before polarity of AC voltage applied to the display element is inverted and a predetermined second period after the polarity of the AC voltage is inverted; and holding off inversion of the polarity of the AC voltage, for an output period of the enable signal and the predetermined first period after the output period.

* * * * *